US006521554B1

(12) United States Patent
Wildeman

(10) Patent No.: US 6,521,554 B1
(45) Date of Patent: Feb. 18, 2003

(54) STITCHBONDED UPHOLSTERY FABRIC AND PROCESS FOR MAKING SAME

(75) Inventor: Martin Wildeman, Spartanburg, SC (US)

(73) Assignee: Tietex International, Ltd., Spartanburg, SC (US)

( * ) Notice: Subject to any disclaimer, the term of this patent is extended or adjusted under 35 U.S.C. 154(b) by 0 days.

(21) Appl. No.: 09/510,325

(22) Filed: Feb. 22, 2000

Related U.S. Application Data

(60) Provisional application No. 60/121,057, filed on Feb. 22, 1999.

(51) Int. Cl.[7] ..... D04H 3/05

(52) U.S. Cl. ..... 442/366; 442/411; 28/108; 66/190; 66/191; 66/192; 428/119; 428/908.8

(58) Field of Search ..... 428/119, 908.8; 442/411, 366; 28/108; 66/190, 191, 192

(56) References Cited

U.S. PATENT DOCUMENTS

| | | | | | |
|---|---|---|---|---|---|
| 2,910,763 | A | | 11/1959 | Lauterbach | 442/405 |
| 2,970,365 | A | | 2/1961 | Morgenstern | 428/219 |
| 3,014,263 | A | | 12/1961 | Oace | 428/134 |
| 3,317,335 | A | | 5/1967 | Marrinan et al. | 428/91 |
| 3,643,301 | A | * | 2/1972 | Weigl et al. | 28/155 |
| 3,649,427 | A | | 3/1972 | Hughes | 442/403 |
| 4,306,430 | A | * | 12/1981 | Warsop | 66/193 |
| 4,631,933 | A | * | 12/1986 | Carey, Jr. | 66/192 |
| 4,737,394 | A | | 4/1988 | Zafiroglu | 428/102 |
| 5,104,703 | A | * | 4/1992 | Rachman et al. | 428/35.6 |
| 5,203,186 | A | * | 4/1993 | Zafirogku | 66/192 |
| 5,585,169 | A | * | 12/1996 | Schnegg et al. | 442/314 |
| 5,600,974 | A | * | 2/1997 | Schnegg et al. | 156/148 |

FOREIGN PATENT DOCUMENTS

| | | | |
|---|---|---|---|
| EP | 0443541 A2 | * | 8/1991 |
| EP | 0476193 A1 | * | 3/1992 |
| FR | 2011835 | * | 3/1970 |
| GB | 1267945 | * | 3/1972 |
| GB | 1602878 | * | 11/1981 |
| WO | 9424353 | * | 10/1994 |
| WO | 0017435 | * | 3/2000 |

OTHER PUBLICATIONS

International Search Report Dated Jun. 16, 2000 for International Application No. PCT/US00/04451, filed Feb. 22, 2000, entitled "Stitchbonded upholstery fabric and process for making same".*

* cited by examiner

*Primary Examiner*—Terrel Morris
*Assistant Examiner*—John J. Guarriello
(74) *Attorney, Agent, or Firm*—Dority & Manning, P.A.

(57) ABSTRACT

A wear resistant stitchbonded fabric is provided. The stitchbonded fabric includes a first yarn loosely stitchbonded into the substrate so as to substantially cover one side of the substrate. The fabric further includes a second yarn that is tightly stitchbonded into the substrate. In one embodiment, the nonwoven substrate can further contain binder fibers which are fused to adjacent fibers. Through this configuration, a fabric is produced having a tapestry-like look. The fabric can be used in many diverse applications, such as being used as an upholstery fabric.

20 Claims, 1 Drawing Sheet

STITCHBONDED UPHOLSTERY FABRIC AND PROCESS FOR MAKING SAME

RELATED APPLICATIONS

The present application is based on a Provisional application filed on Feb. 22, 1999 and having application Ser. No. 60/121,057.

FIELD OF THE INVENTION

The present invention generally relates to fabric well suited for covering upholstery. More particularly, the present invention is directed to a stitchbonded upholstery fabric and to a process for making the fabric.

BACKGROUND OF THE INVENTION

A stitchbonded fabric generally refers to a fabric made from a nonwoven web in which the fibers of the web are connected by stitches sewn or knitted through the web. The stitches are typically applied to the webs in rows. In one type of stitchbonded fabric, referred to as maliwatt stitchbonded fabrics, the needles that are punched through the nonwoven substrate are threaded so that stitchbonded threaded rows are formed into the fabric.

In general, stitchbonded fabrics are relatively inexpensive to produce in comparison to many other woven fabrics. In the past, these types of fabrics have been used in many diverse and various applications. Conventionally made stitchbonded fabrics, however, have had their limitations. In particular, it has been difficult in the past to produce stitchbonded fabrics for use in high wear applications.

For instance, since the fabrics are made from a nonwoven substrate, they have a tendency to undergo pilling over time in high friction environments. Pilling refers to the formation of small balls or fuzz that develop on the fabric.

Also, conventionally made stitchbonded fabrics typically have an inherent degree of stretch created by the manner in which the fabrics are made. This stretch characteristic may be undesirable in certain high wear applications, such as when the fabric is used to cover furniture. For instance, in these applications, a stretchable fabric may not perform as well and may also adversely effect the appearance of the covered product.

In view of the above deficiencies, a need currently exists for a stitchbonded fabric that may be used in high wear applications, such as for use as an upholstery fabric. A need also exists for a stitchbonded fabric that is resistant to pilling and can be made without a significant amount of stretch in at least one direction. Further, a need exists for a stitchbonded upholstery fabric that has a unique aesthetic appearance and that will readily accept a printed pattern.

SUMMARY OF THE INVENTION

The present invention recognizes and addresses the foregoing disadvantages, and others of prior art constructions and methods.

Accordingly, it is an object of the present invention to provide a wear resistant stitchbonded fabric.

Another object of the present invention is to provide a stitchbonded upholstery fabric.

These and other objects of the present invention are achieved by providing a wear resistant stitchbonded fabric made from a nonwoven web. The nonwoven web can contain fibers, such as staple fibers having a denier of from about 2 to about 6. The nonwoven web can have a basis weight of from about 50 gsm to about 200 gsm and, in one embodiment, can be a carded and cross-lapped web.

In one embodiment, the nonwoven web can contain binder fibers in an amount from about 2% to about 10% by weight. For instance, the binder fibers can be bicomponent fibers containing a core polymer and a sheath polymer.

In accordance with the present invention, a first yarn is stitchbonded into a first side of the nonwoven web, while a second yarn is stitchbonded into a second side of the nonwoven web. The yarns can be stitchbonded into the web so as to create at least 14 stitchbonded rows per inch, particularly at least 22 stitchbonded rows per inch, and more particularly at least 28 stitchbonded rows per inch. The stitch density can vary for each yarn and can range from about 8 stitches per inch to about 30 stitches per inch and particularly from about 12 stitches per inch to about 16 stitches per inch.

The first yarn is loosely stitchbonded into the web so as to substantially cover the first side of the web. The first yarn can have a denier of from about 70 to about 300, and particularly from about 120 to about 170. The first yarn is preferably a multifilament polyester yarn. In one embodiment, the first yarn is a texturized yarn containing crimps.

The second yarn, on the other hand, is more tightly stitchbonded into the web in comparison to the first yarn and has a smaller denier than the first yarn. For instance, the second yarn can be a multifilament polyester yarn having a denier of from about 50 to about 150 and particularly from about 50 to 100.

In accordance with the present invention, the second yarn is a shrinkable yarn, such as a yarn that will shrink when exposed to heat. In this regard, once the first yarn and the second yarn have been stitchbonded into the nonwoven web, the second yarn is shrunk at least 5% and particularly from about 5% to about 10%. In this manner, the second yarn more tightly secures the fabric together and makes the first yarn even more loosely stitchbonded into the web. Consequently, the first yarn creates a surface on the fabric that gives the fabric a tapestry-like look.

The process for producing the fabric of the present invention generally includes the steps of first providing a nonwoven web containing binder fibers. The first yarn and the second yarn are stitchbonded into each side of the web as described above. Once the yarns are stitchbonded into the web, the web is then heated causing the second yarn to shrink at least 5%. During heating, the binder fibers also melt and fuse with adjacent fibers reducing the stretch characteristics of the fabric. In one embodiment, the binder fibers can be generally oriented in a direction perpendicular to the stitchbonded rows. In this manner, once heated, the binder fibers give integrity to the fabric in a direction perpendicular to the stitchbonded yarns.

Other objects, features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, including reference to the accompanying figure, in which, The FIGURE illustrates one embodiment of a stitchbonded fabric made in accordance with the present invention.

Repeat use of reference characters in the present specification and drawings is intended to represent same or analogous features or elements of the invention.

DETAILED DESCRIPTION OF PREFERRED EMBODIMENTS

Figure 1:
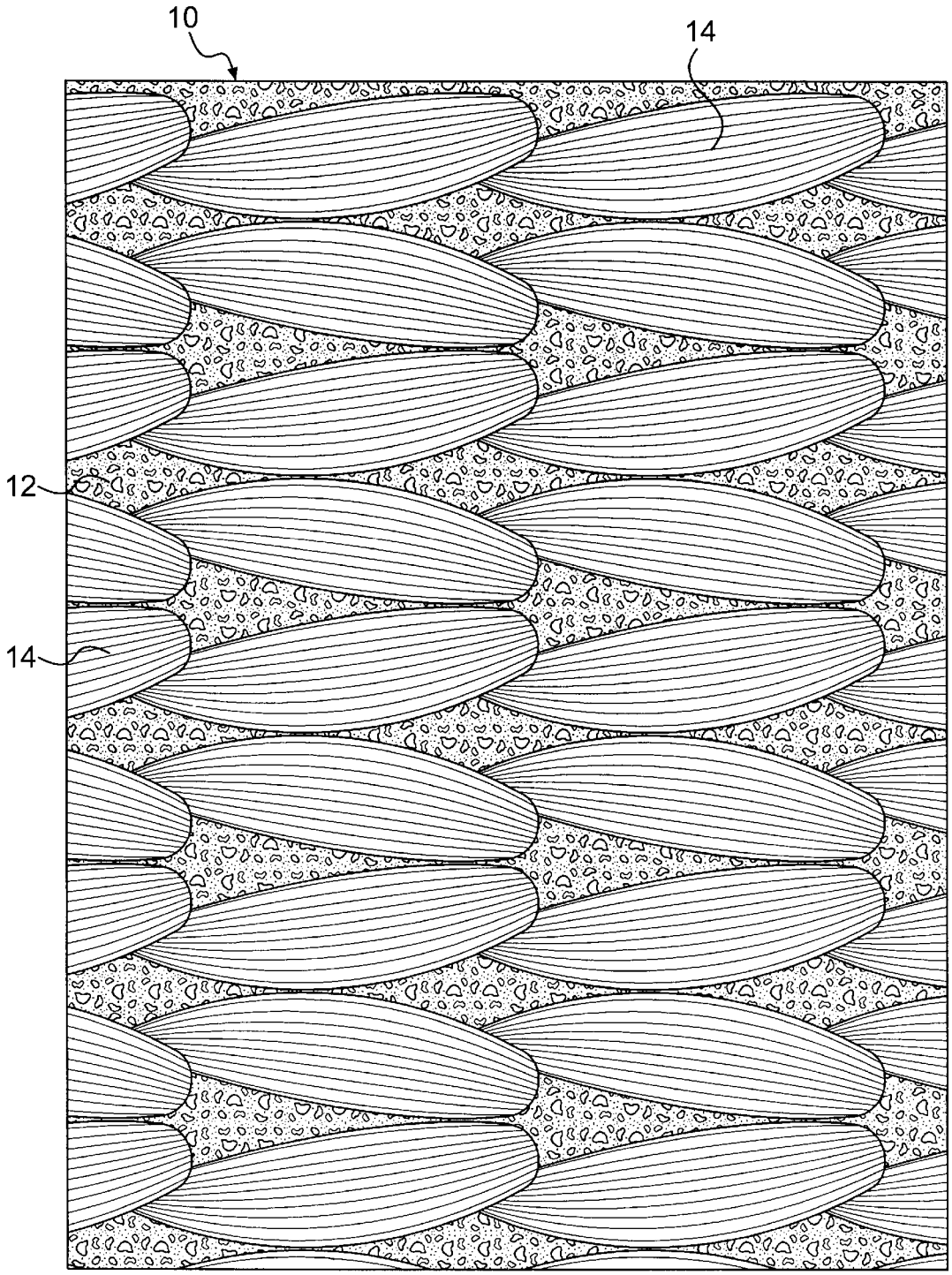

It is to be understood by one of ordinarily skill in the art that the present discussion is a description of exemplary embodiments only, and is not intended as limiting the broader aspects of the present invention, which broader aspects are embodied in the exemplary constructions.

The present invention is generally directed to a maliwatt stitchbonded fabric that can be used in high wear and high friction applications. For example, the stitchbonded fabric of the present invention is particularly well suited for use as an upholstery fabric for covering furniture and the like. The fabric is pill resistant and has a unique tapestry-like appearance. If desired, the fabric can be produced with little to no stretch characteristics in the direction perpendicular to the stitchbonded rows, which preserves the appearance of the fabric when used to cover furniture and the like.

Besides being wear resistant, fabrics made according to the present invention are relatively inexpensive to produce and readily accept printed patterns. For instance, fabrics made according to the present invention can be fed through a flexographic printing process or a heat transfer printing process for placing any desired printed design or pattern onto the fabric. Overall, the finished fabric product has a unique tapestry-like look. The fabric can also be made having a textured surface that further enhances its appeal.

In general, the upholstery fabric of the present invention comprises a two bar maliwatt stitchbonded fabric. As is known in the art, a two bar maliwatt fabric refers to a stitchbonded fabric in which a first bar of needles stitches a thread or yarn into the front of the fabric and a second bar of needles stitchbonds a second thread or yarn into the back of the fabric. In the stitchbonded fabric made according to the present invention, the yarn stitched into the front of the fabric has a relatively high denier and is loosely stitched into the fabric. The yarn stitchbonded into the back of the fabric, however, is a shrinkable yarn that is more tightly inserted into the fabric for giving the fabric integrity. Through this process, the high denier yarn loosely stitched into the front of the fabric substantially covers the nonwoven substrate, preventing the substrate from pilling. The high denier yarn also forms a printable surface and ultimately gives the fabric a tapestry-like look.

The construction of fabrics made in accordance with the present invention will now be described in more detail.

The nonwoven substrate used to form the stitchbonded fabric is preferably a fiber fleece. For instance, the nonwoven substrate can be formed from staple fibers made from a synthetic material, such as polyester. The staple fibers can have a denier of from about 2 to about 6 and in one embodiment have a denier of about 4.

Although the fiber fleece can be formed according to various processes including an air laid process, preferably the fiber fleece comprises a carded and cross-lapped nonwoven web. The basis weight of the nonwoven substrate can vary depending upon the particular application for which the fabric is to be used. For most applications, however, the nonwoven substrate can have a basis weight of from about 50 gsm to about 200 gsm or higher. In one embodiment, the basis weight of the substrate is about 80 gsm.

As described above, the stitchbonded fabric of the present invention can have a tapestry-like appearance. In order to enhance this effect, the nonwoven substrate can be formed from a darker colored fiber. In this manner, when the fabric is constructed, the nonwoven substrate provides a dark background for the pattern that is printed upon the stitchbonded yarns. This contrast in colors creates a unique aesthetic appearance.

As described in the background section above, many upholstery fabrics are preferably not stretchable. In order to reduce the stretch characteristics of the stitchbonded fabric of the present invention, in one embodiment, binder fibers can be incorporated into the nonwoven substrate. As used herein, binder fibers refer to fibers that when subjected to heat will bond with one another and with other materials contained within the web. Consequently, many binder fibers are made from synthetic materials having a relatively low softening temperature. Although the binder fibers can be made entirely from a low melting point polymer, in one particular embodiment of the present invention, the binder fibers incorporated into the nonwoven substrate are multicomponent fibers, such as bicomponent fibers.

For instance, in one embodiment, bicomponent fibers are used containing a core polymer surrounded by a sheath polymer. The core polymer can be made from a heat resistant material, such as a heat resistant polyester. The sheath polymer, however, can be made from a polymer having a relatively low softening temperature, such as a low melt polyester or copolyester. Besides using polyesters, other polymers may be used to construct the bicomponent fibers, such as polyethylene, polypropylene and nylon. In one embodiment, the bicomponent fibers can have a denier of about 3.

In one embodiment, the bicomponent fibers contain a polyester core polymer having a melting temperature of at least 430° F. The sheath polymer, on the other hand, can be a copolyester having a melt temperature no greater than about 350° F., such as at about 320° F.

When present, the binder fibers can be incorporated into the nonwoven substrate in an amount of from about 2% to about 10% by weight and particularly in an amount of about 5% by weight. The binder fibers can be oriented in the web in the width direction, or, in other words, in the direction perpendicular to the stitchbonded rows. In this manner, the binder fibers reduce the stretch characteristics of the fabric in the width direction so that when the fabric is used, the stitchbonded rows do not become pulled or stretched apart which may adversely effect the appearance of the fabric.

Once the nonwoven substrate is constructed, the substrate is fed into a stitchbonding process wherein a first yarn is stitchbonded into the front or face side of the substrate, while a second yarn is stitchbonded into the back side of the substrate. The first yarn is a high denier, texturized yarn that is loosely stitchbonded into the nonwoven substrate. The first yarn should also be stitchbonded into the nonwoven web using a fine gauge row of needles. In particular, the yarn should be stitchbonded into the fabric using at least 22 needles per inch, and preferably using 28 needles per inch.

By using a high denier yarn, by loosely stitchbonding the yarn into the web, and by creating a high density of stitchbonded rows, the yarn stitchbonded into the front of the web balloons and covers the staple fibers used to make the web. In this manner, the stitchbonded yarn protects the staple fibers and prevents the nonwoven substrate from being exposed to wear.

The yarn stitchbonded into the front of the web, for instance, can be a multifilament yarn having a denier of from about 70 to about 300. In one embodiment, a 150 denier multifilament yarn made from polyester can be used. The multifilament yarn can be made from about 100 filaments wherein each filament can have a denier of about 1.5.

Preferably, the high denier yarn is also texturized so that the yarn will not easily slide in and out of the web. As is known in the art, a textured yarn refers to a yarn containing crimps. For instance, in one process for texturizing yarn, the yarn is fed through frictional discs which twist the yarn and create crimps. Once heated, the crimps become heat set into place.

As opposed to the first yarn stitchbonded into the front of the fabric, the second yarn stitchbonded into the back of the fabric is preferably a lower denier yarn that is shrinkable when exposed to heat. Further, the second yarn is also preferably more tightly stitchbonded into the web in relation the first yarn at the same gauge (needles per inch) as described above. Once incorporated into the web, the second yarn is not visible from the front side of the fabric but provides the web with integrity and will support loads placed on the fabric.

In one embodiment, the yarn stitchbonded into the back of the web is a multifilament polyester yarn having a denier of from about 50 to about 150. In one preferred embodiment, the multifilament yarn can have a denier of about 70 and can be made from about 34 filaments. As opposed to being texturized, the yarn can be a draw warped yarn, which refers to a relatively straight yarn that has been stretched.

As described above, the yarn that is stitchbonded into the back of the nonwoven substrate is also shrinkable, such as various commercially available polyester yarns. For instance, the yarn should shrink at least 5%, and particularly about 5% to about 10% when exposed to elevated temperatures for a short period of time.

In accordance with the present invention as will be described in more detail hereinafter, once the nonwoven substrate has been stitchbonded in the front and back, the fabric is heat treated, causing the back side yarn to shrink while the front side yarn does not. In this manner, the back side yarn becomes even more tightly incorporated into the web while the front side yarn becomes even looser. Further, during heat treatment, any binder fibers that may be present in the web melt and bond the web together.

More particularly, once the woven substrate has been stitchbonded, the stitchbonded fabric can be placed on a tenter frame. To allow for shrinkage of the yarns stitchbonded into the back side of the nonwoven substrate, the fabric can be overfed from about 5% to about 10% on the tenter frame in the warp or lengthwise direction. The fabric is then fed through an oven which, in one embodiment, exposes the fabric to a temperature of from about 375° F. to about 400° F. for a short amount of time, such as about 30 seconds. When heated, the backside stitchbonded yarn shrinks the same amount the fabric is overfed on the tenter frame. Simultaneously, binder fibers contained within the fabric melt substantially reducing the ability of the fabric to stretch in the width direction. As a result of shrinkage, the high denier yarn stitchbonded into the front side of the fabric increases in looseness and thus further increases the coverage of the yarn over the surface of the fabric.

Once heat treated, the fabric can be immediately used as desired or, in one embodiment, a pattern can be printed onto the yarns stitchbonded into the front of the fabric. Any desired pattern or design can be printed onto the front side of the fabric. Further, any suitable method can be used to print a pattern onto the fabric. Examples of printing techniques that may be used in the process of the present invention include using a flexographic printing process or a heat transfer printing process.

Once completely constructed, the fabric has many uses and applications. For instance, the fabric is well suited to covering furniture and other similar objects.

One embodiment of a stitchbonded fabric generally 10 made in accordance with the present invention is illustrated. As shown, stitchbonded fabric 10 includes a nonwoven substrate 12 that has been stitchbonded with a first yarn 14. A second yarn is also stitchbonded into the substrate. The second yarn is generally not visible when viewing the product. In particular, the first yarn 14 has a tendency to mask the second yarn.

First yarn 14 is loosely stitched into the substrate, while the second yarn is tightly stitched into the substrate. In this manner, first yarn 14 forms a surface on the fabric capable of accepting a printed pattern. Further, this configuration gives the fabric a tapestry-like look, especially when substrate 12 has a darker color, such as a dark blue or black.

These and other modifications and variations to the present invention may be practiced by those of ordinary skill in the art, without departing from the spirit and scope of the present invention. In addition, it should be understood that aspects of the various embodiments may be interchanged both in whole or in part. Furthermore, those of ordinary skill in the art will appreciate that the foregoing description is by way of example only, and is not intended to limit the invention.

What is claimed:

1. A wear resistant stitchbonded fabric comprising:

a nonwoven web having a first side and a second side;

a first yarn stitchbonded into said first side of said nonwoven web so as to form a plurality of stitchbonded rows, said yarn being stitched into said web so as to substantially cover the first side of said web, the first yarn being stitchbonded into the nonwoven web so as to form at least 22 stitchbonded rows per inch;

a second yarn stitchbonded into said nonwoven web, said second yarn being more tightly stitched into said web than said first yarn; and wherein said second yarn has been shrunk at least 5% after having been stitched into said nonwoven web.

2. A wear resistant stitchbonded fabric as defined in claim 1, wherein said nonwoven web contains binder fibers that have been melted and fused with adjacent fibers.

3. A wear resistant stitchbonded fabric comprising:

a nonwoven web having a first side and a second side, the nonwoven web containing binder fibers;

a first yarn stitchbonded into said first side of said nonwoven web so as to form a plurality of stitchbonded rows, said yarn being stitched into said web so as to substantially cover the first side of said web;

a second yarn stitchbonded into said nonwoven web, said second yarn being more tightly stitched into said web than said first yarn; and wherein said second yarn has been shrunk at least 5% after having been stitched into said nonwoven web; and wherein said binder fibers are present in said nonwoven web in an amount from about 2% to about 10% by weight.

4. A wear resistant stitchbonded fabric as defined in claim 2, wherein said binder fibers comprise bicomponent fibers.

5. A wear resistant stitchbonded fabric as defined in claim 2, wherein said binder fibers are generally oriented in a direction perpendicular to said plurality of stitchbonded rows.

6. A wear resistant stitchbonded fabric as defined in claim 1, wherein said nonwoven web comprises a carded web containing staple fibers, said staple fibers having a denier of from about 2 to about 6.

7. A wear resistant stitchbonded fabric as defined in claim 1, wherein said nonwoven web has a basis weight of from about 50 gsm to about 100 gsm.

8. A wear resistant stitchbonded fabric as defined in claim 1, wherein said nonwoven web has a dark color.

9. A wear resistant stitchbonded fabric as defined in claim 1, wherein said first yarn comprises a texturized multifilament yarn, said first yarn having a denier of from about 70 to about 300.

10. A wear resistant stitchbonded fabric as defined in claim 1, wherein said second yarn has a denier of from about 50 to about 150, and wherein said second yarn has been shrunk from about 5% to about 10%.

11. A wear resistant stitchbonded fabric as defined in claim 1, further comprising a printed pattern applied to said first yarns stitchbonded into said first side of said nonwoven web.

12. A wear resistant stitchbonded fabric as defined in claim 1, wherein said second yarn is stitchbonded into said nonwoven web so as to form at least 22 stitchbonded rows per inch.

13. A wear resistant stitchbonded fabric as defined in claim 1, wherein said first yarn is stitchbonded into said first side of said nonwoven web at a density of from about 8 stitches per inch to about 30 stitches per inch.

14. A wear resistant stitchbonded fabric comprising:

a nonwoven web having a first side and a second side, said nonwoven web containing binder fibers in an amount of at least 2% by weight, said binder fibers being fused with adjacent fibers;

a first yarn stitchbonded into said first side of said nonwoven web so as to form at least 22 stitchbonded rows per inch, said first yarn being stitched into said web so as to substantially cover the first side of said web;

a second yarn stitchbonded into said second side of said nonwoven web so as to form at least 22 stitchbonded rows per inch, said second yarn having a smaller denier than said first yarn, said second yarn being more tightly stitched into said nonwoven web in comparison to said first yarn; and wherein said second yarn has been shrunk at least 5% after having been stitched into said nonwoven web.

15. A wear resistant stitchbonded fabric as defined in claim 14, wherein said nonwoven web comprises a carded web containing staple fibers having a denier of from about 2 to about 6, said binder fibers being present within said nonwoven web in an amount from about 2% to about 10% by weight, said nonwoven web having a basis weight of from about 50 gsm to about 200 gsm.

16. A wear resistant stitchbonded fabric as defined in claim 15, wherein said binder fibers comprise bicomponent fibers.

17. A wear resistant stitchbonded fabric as defined in claim 14, wherein said first yarn and said second yarn are stitchbonded into said nonwoven web so as to form at least 28 stitchbonded rows per inch.

18. A wear resistant stitchbonded fabric as defined in claim 14, wherein said first yarn has a denier of from about 120 to about 170 and said second yarn has a denier of from about 50 to about 100.

19. A wear resistant stitchbonded fabric as defined in claim 14, wherein said first yarn is stitchbonded into said nonwoven web at a density of from about 8 stitches per inch to about 30 stitches per inch.

20. A wear resistant stitchbonded fabric as defined in claim 14, further comprising a printed pattern applied to said first yarn stitchbonded into said first side of said nonwoven web.

* * * * *